US009433952B2

(12) United States Patent
Heldt et al.

(10) Patent No.: US 9,433,952 B2
(45) Date of Patent: Sep. 6, 2016

(54) SPRAY HEAD FOR A DEVICE FOR DISPENSING A FLUID PRODUCT

(75) Inventors: Frédéric Heldt, Louviers (FR); Jean-Marc Pardonge, Les Authieux sur port St Ouen (FR); Ludovic Petit, Vitot (FR)

(73) Assignee: APTAR FRANCE SAS, Le Neubourg (FR)

( * ) Notice: Subject to any disclaimer, the term of this patent is extended or adjusted under 35 U.S.C. 154(b) by 104 days.

(21) Appl. No.: 13/809,039

(22) PCT Filed: Jul. 7, 2011

(86) PCT No.: PCT/FR2011/051623

§ 371 (c)(1),
(2), (4) Date: Mar. 27, 2013

(87) PCT Pub. No.: WO2012/004539

PCT Pub. Date: Jan. 12, 2012

(65) Prior Publication Data

US 2013/0181069 A1 Jul. 18, 2013

(30) Foreign Application Priority Data

Jul. 9, 2010 (FR) ..... 10 55626

(51) Int. Cl.
*B05B 1/34* (2006.01)
*B05B 1/30* (2006.01)
(Continued)

(52) U.S. Cl.
CPC . *B05B 1/30* (2013.01); *B05B 1/06* (2013.01); *B05B 1/3421* (2013.01); *B05B 11/007* (2013.01); *B05B 11/02* (2013.01)

(58) Field of Classification Search
CPC ..... B05B 1/20; B05B 1/02; B05B 1/06; B05B 1/34; B05B 1/3405; B05B 1/341; B05B 1/3421; B05B 10/0062; B05B 11/007; B05B 11/02
USPC ..... 239/463, 468–476, 482–484, 490–493, 239/504–507, 513, 514, 518–520, 537–539, 239/541, 320–324
See application file for complete search history.

(56) References Cited

U.S. PATENT DOCUMENTS 1,536,982 A * 5/1925 Strachan et al. ..... 239/484
5,601,077 A 2/1997 Imbert
(Continued)

FOREIGN PATENT DOCUMENTS

EP 0 526 824 A2 2/1993
EP 1 475 157 A1 11/2004
(Continued)

OTHER PUBLICATIONS

International Search Report of PCT/FR2011/051623 dated Nov. 11, 2011.

*Primary Examiner* — Christopher Kim
(74) *Attorney, Agent, or Firm* — Sughrue Mion, PLLC

(57) ABSTRACT

A spray head for a fluid dispenser device, including a hollow body having a substantially cylindrical sleeve and extending along a longitudinal axis (A), a substantially radial end wall provided with a spray orifice; and a spray profile upstream from the spray orifice. The spray profile includes at least one channel that is non-radial and/or non-axial relative to the longitudinal axis (A). The head, the spray orifice, and the spray profile are made as a single piece, the spray profile including a central pin, the internal end of the central pin, arranged inside the hollow body, being of shape that is conical or frustoconical, so as to guide the fluid towards the at least one non-radial and/or non-axial channel, the internal end forming an outlet valve.

14 Claims, 5 Drawing Sheets

(51) Int. Cl.

| | |
|---|---|
| ***B05B 1/06*** | (2006.01) |
| ***B05B 11/00*** | (2006.01) |
| ***B05B 11/02*** | (2006.01) |

(56) References Cited

U.S. PATENT DOCUMENTS

| | | | | |
|---|---|---|---|---|
| 6,663,591 | B1 * | 12/2003 | d'Ussel | 604/110 |
| 6,789,750 | B1 | 9/2004 | Heldt | |
| 7,785,314 | B2 * | 8/2010 | Miller et al. | 604/508 |
| 2004/0238574 | A1 | 12/2004 | Merk et al. | |
| 2007/0131799 | A1 | 6/2007 | Le Maner et al. | |

FOREIGN PATENT DOCUMENTS

| | | | |
|---|---|---|---|
| FR | 2 793 708 | A1 | 11/2000 |
| FR | 2 862 009 | A1 | 5/2005 |
| WO | 00/71263 | A1 | 11/2000 |
| WO | 2007/012853 | A1 | 2/2007 |

* cited by examiner

SPRAY HEAD FOR A DEVICE FOR DISPENSING A FLUID PRODUCT

CROSS REFERENCE TO RELATED APPLICATIONS

This application is a National Stage of International Application No. PCT/FR2011/051623 filed Jul. 7, 2011, claiming priority based on French Patent Application No. 1055626 filed Jul. 9, 2010, the contents of all of which are incorporated herein by reference in their entirety.

The present invention relates to a spray head for a fluid dispenser device.

Spray heads for fluid dispenser devices are well known. Such heads generally comprise a plurality of parts, namely a body forming the head, and one or two parts forming the nozzle, i.e. the portion that creates the spray by causing the fluid to swirl when it is dispensed. For an external nozzle, a small sleeve is engaged from the outside into the downstream end of the head so as to co-operate therewith to define said spray profile. For an internal nozzle, it is an insert inserted from the inside of the head that co-operates with the end wall thereof so as to define the spray profile. Either way, the spray profiles generally include a plurality of non-radial channels, in particular three, formed either in the end wall of the head, or in the sleeve forming the external nozzle, or in the insert forming the internal nozzle. However, under all circumstances, spraying is achieved only by co-operation between the two parts, i.e. the head with at least an external nozzle or an internal nozzle. Existing spray heads require at least one part to be assembled in another. Such assembly leads to differences in performance from one spray head to another. This is not always desirable. In addition, making the heads with two or three parts complicates manufacture and assembly, and thus makes said assembly more costly. Generally, spray heads are assembled on piston rods or valve members so as to guide the fluid that is dispensed from the pump or the valve towards the spray orifice. However, it has also been proposed to arrange a spray head directly on the outlet of a syringe-type reservoir so as to spray the content of said syringe rather than inject it through a needle. Document WO 00/71263 describes such an arrangement. Once again, such spray heads are still made with two or more parts that are assembled together. Documents EP 1 475 157, FR 2 862 009, and WO 2007/012853 describe prior-art devices.

An object of the present invention is to provide a spray head for a fluid dispenser device that does not have the above-mentioned drawbacks.

Another object of the present invention is to provide a spray head for a fluid dispenser device that is simple and inexpensive to manufacture and to assemble.

Another object of the present invention is to provide such a spray head for a fluid dispenser device that makes it possible to create a correct and reproducible spray.

The present invention thus provides a spray head for a fluid dispenser device, said spray head comprising: a hollow body comprising a sleeve that is substantially cylindrical and that extends along a longitudinal axis, and an end wall that is substantially radial and that is provided with a spray orifice; and a spray profile upstream from said spray orifice, said spray profile comprising at least one channel that is non-radial and/or non-axial relative to said longitudinal axis; said head, said spray orifice, and said spray profile being made as a single piece, said spray profile including a central pin, the internal end of said central pin, arranged inside said hollow body, being of shape that is conical or frustoconical, so as to guide the fluid towards said at least one non-radial and/or non-axial channel, said internal end forming an outlet valve.

In a first variant embodiment, said spray orifice is of annular shape around said longitudinal axis.

In a second variant embodiment, said spray orifice is in the shape of a bowl that is symmetrical about said longitudinal axis.

Advantageously, said spray profile includes at least one channel that extends in sloping and peripheral manner relative to the longitudinal axis, connecting the inside of said hollow body to said spray orifice.

In a variant, said spray profile includes at least one helical channel that slopes in the radial and axial directions, connecting the inside of said hollow body to said spray orifice.

Advantageously, said central pin is connected to said sleeve via a deformable diaphragm made integrally therewith and enabling said central pin to move axially a little.

The present invention also provides a fluid dispenser device comprising a reservoir, dispenser means for dispensing fluid contained in said reservoir, and a spray head as described above.

Advantageously, said reservoir is a syringe, and said dispenser means comprise a piston that slides in said syringe, said spray head being assembled directly on said syringe.

Advantageously, said spray head includes an outlet valve that co-operates with said syringe.

In a variant, said dispenser means comprise a pump or a valve assembled on said reservoir, said spray head being assembled on said pump or valve.

These advantages and characteristics and others of the present invention appear more clearly from the following detailed description, given by way of non-limiting example, and with reference to the accompanying drawing, and in which.

The present invention is described below with reference to three different embodiments, but naturally other embodiments could be envisaged.

Figure 1:
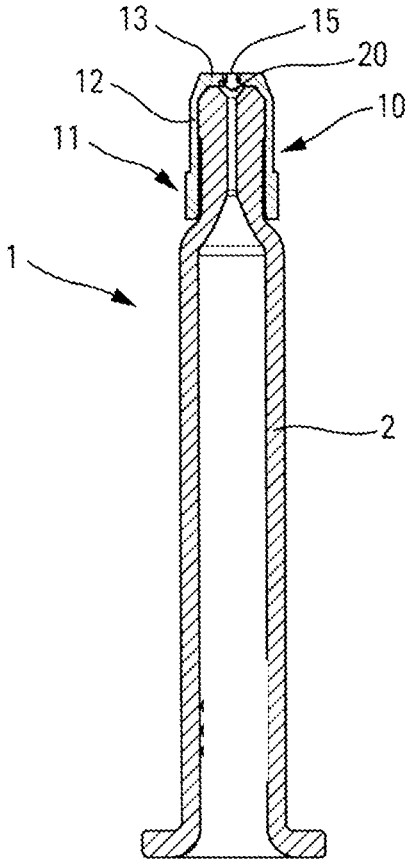
FIG. 1 is a diagrammatic section view of a spray head in an advantageous embodiment, assembled on a syringe-type reservoir.
Figure 2:
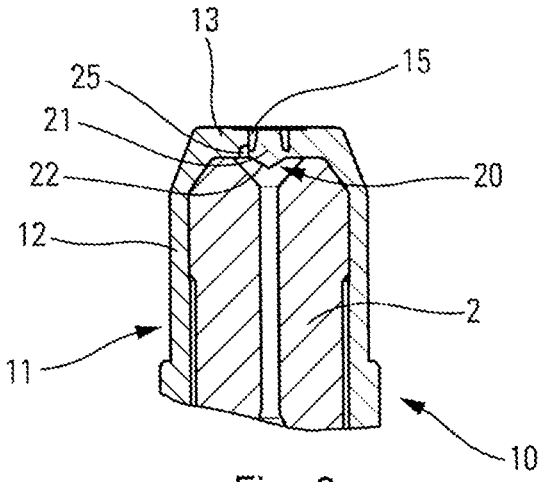
FIG. 2 is a larger-scale detail view of a portion of the FIG. 1 device.
Figure 4:
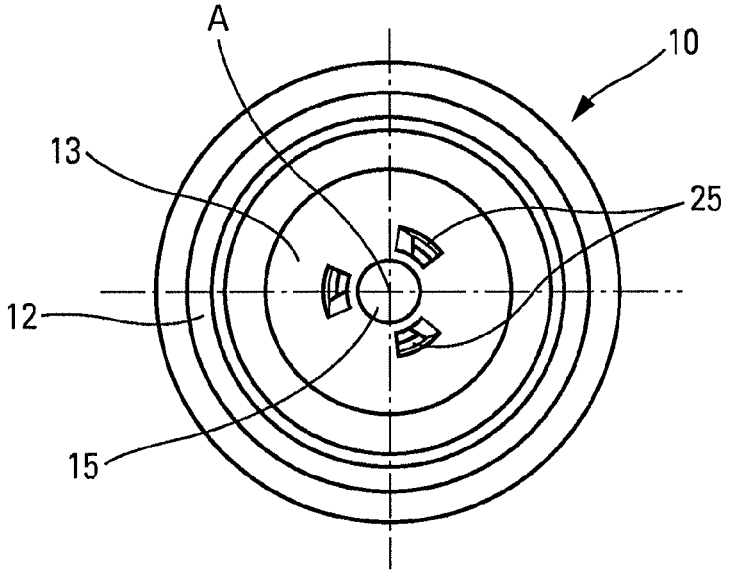
FIG. 4 is a plan view of the head shown in FIG. 3.
Figure 9:
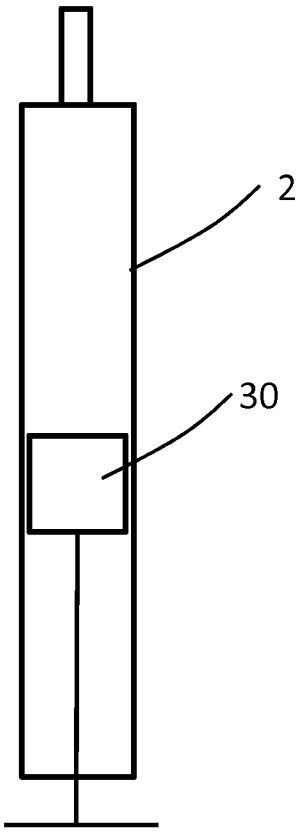
FIG. 9 is a schematic illustration of a syringe with its piston.

FIGS. 1 and 4 show a first advantageous embodiment. FIG. 1 shows a spray head 10 assembled on a reservoir 2 of the syringe type. In conventional manner, appropriate dispenser means may be provided in said syringe 2 for dispensing its content. Typically, the dispenser means comprise, for example, a piston 30 as schematically illustrated in FIG. 9 that can be secured to an actuator rod that is actuated by the user while dispensing. Naturally, various dispenser means could be envisaged, e.g. automatic dispenser means of the auto-injector type. Nevertheless, since these dispenser means are not directly involved in the present invention, they are not described in greater detail below. In addition, although FIG. 1 shows a dispenser head 10 assembled directly on a reservoir 2, the dispenser head could also be assembled on a dispenser member, such as a pump or a valve, which is itself assembled on a reservoir.

Figure 3:
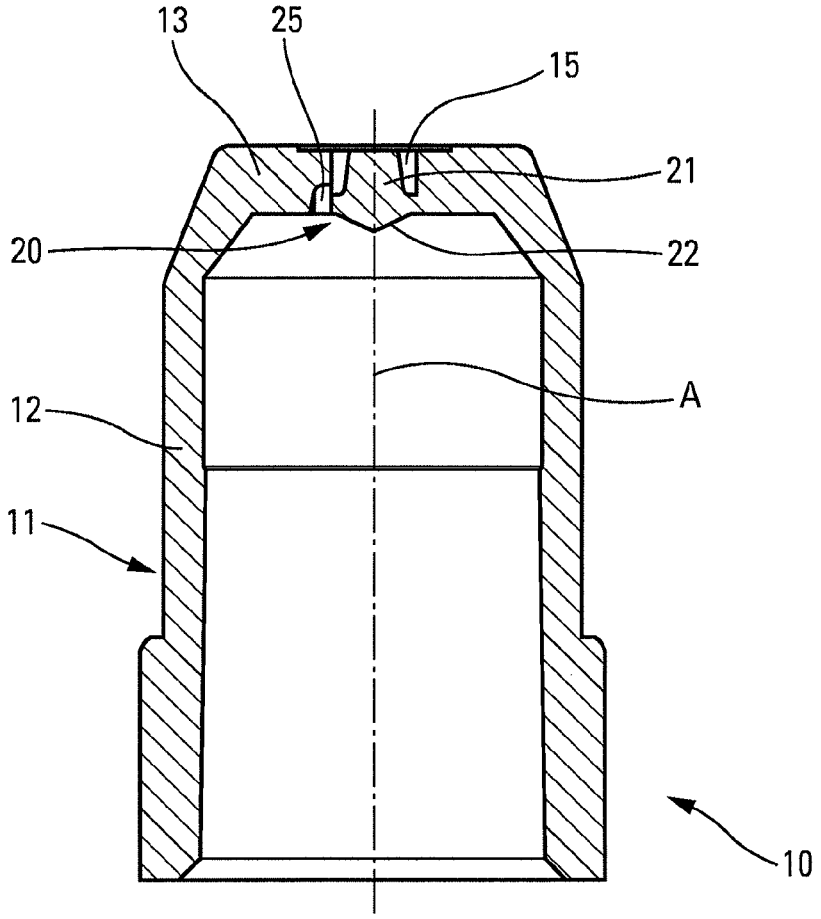
FIG. 3 is a diagrammatic section view of the dispenser head of the device in FIGS. 1 and 2.

With reference more particularly to FIG. 3, it should be observed that the dispenser head 10 comprises a hollow body 11 including a spray orifice 15. The hollow body 11 advantageously comprises a sleeve 12 that is substantially cylindrical and that is connected to an end wall 13 that is substantially radial and that includes said spray orifice 15, preferably at its center, and thus on the longitudinal axis A of said hollow body 11. In addition, a spray profile 20 is provided, preferably likewise at said end wall 13.

In the invention, said dispenser head is made as a single piece. Thus, the fluid is sprayed by a single piece, and it is not necessary to assemble together one or more parts fitted on or in said head in order to create the spray.

In the embodiment shown in FIGS. 1 to 4, the spray profile 20 includes at least one channel that extends, in sloping manner, in the axial direction defined by the longitudinal axis A of the hollow body 11. As can be seen in FIG. 4, there are preferably three channels of this type distributed around the longitudinal axis A. The channels 25 extend, in peripheral manner, relative to said longitudinal axis A, and thus axially, in sloping manner, in said end wall 13, so as to connect the inside of the hollow body 11 to said spray orifice 15. The peripheral shape of the channels 25, which are thus portions of a circle, and which slope in the axial direction, causes the fluid to swirl when it passes through said channels 25 while it is being expelled under pressure. When the fluid reaches the spray orifice 15, it is thus already swirling, and is thus dispensed in the form of a spray. In the embodiment shown in FIG. 3, the spray orifice 15 is of an annular shape around said longitudinal axis A. The annular shape causes the fluid to swirl even more on being expelled.

As can be seen in particular in FIG. 3, the spray profile 20 includes a central pin 21. In this variant embodiment, the outer portion of the central pin defines said annular shape of the spray orifice 15. At its internal end 22 that is arranged inside the hollow body 11, said central pin 21 is of shape that is conical or frustoconical, and that serves in particular to guide the fluid towards the inlet of said channels 25. Thus, as can be seen in particular in FIG. 2, when the head 10 is assembled on the reservoir 2, the fluid that is expelled from said reservoir 2 is delivered to said spray channels, and is thus dispensed in the form of a spray through the spray orifice 15. Naturally, the same applies if the dispenser head 10 is assembled on a piston rod or a valve member.

Figure 5:
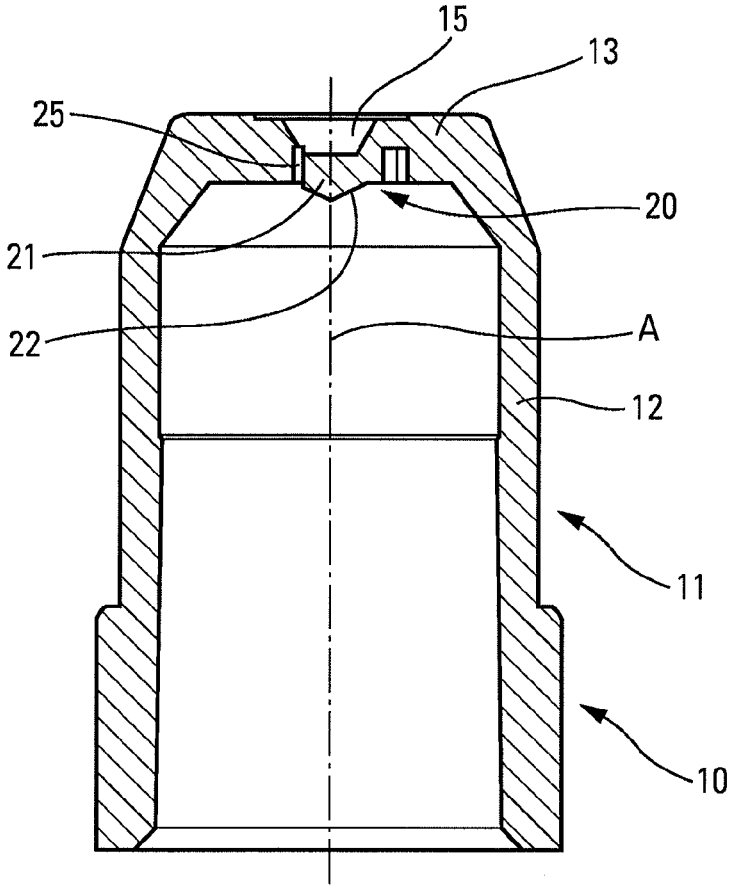
FIG. 5 is a view similar to the view in FIG. 3 showing another embodiment.
Figure 6:
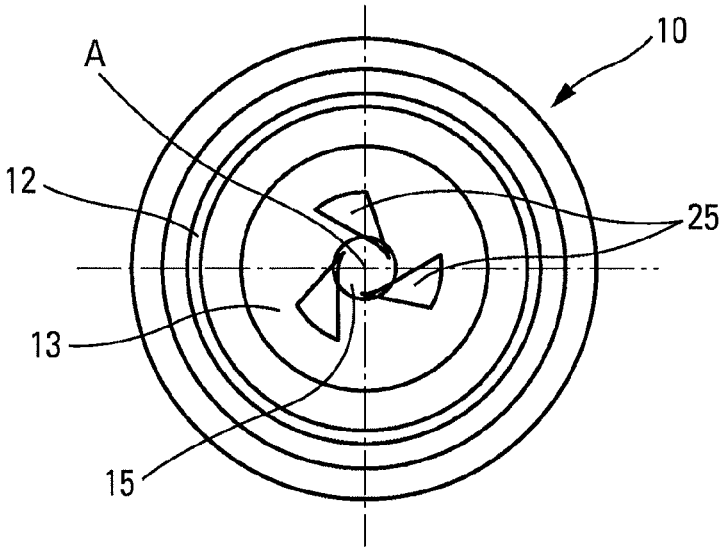
FIG. 6 is a plan view of the head shown in FIG. 5.

FIGS. 5 and 6 show another embodiment. This second embodiment differs from the first embodiment in FIGS. 1 to 4 mainly by the shape of the channels 25, and of the spray orifice 15. Thus, with reference to FIGS. 5 and 6, it should be observed that, in this embodiment, the spray orifice 15 is made in the form of a bowl that is substantially symmetrical about the longitudinal axis A, and the channels 25, also preferably three in number, comprise helical sloping channels that connect the inside of the hollow body 11 to said spray orifice 15. In this variant, said channels 25 thus extend in sloping manner not only in the axial direction but also in the radial direction, since they are not peripheral around said longitudinal axis, but, on the contrary, helical, i.e. they come progressively closer to said axis in the radial direction. Once again, the particular shape of the channels enables the fluid to swirl in the spray orifice 15 while it is being dispensed. Naturally, the channels of this second embodiment could be associated with an annular spray orifice, as shown in FIG. 3. In addition, the bowl-shaped spray orifice in FIG. 5 could be associated with the channels of the first embodiment in FIGS. 1 to 4. Optionally, channels made in the two above-described embodiments could be associated and/or combined.

Figure 7:
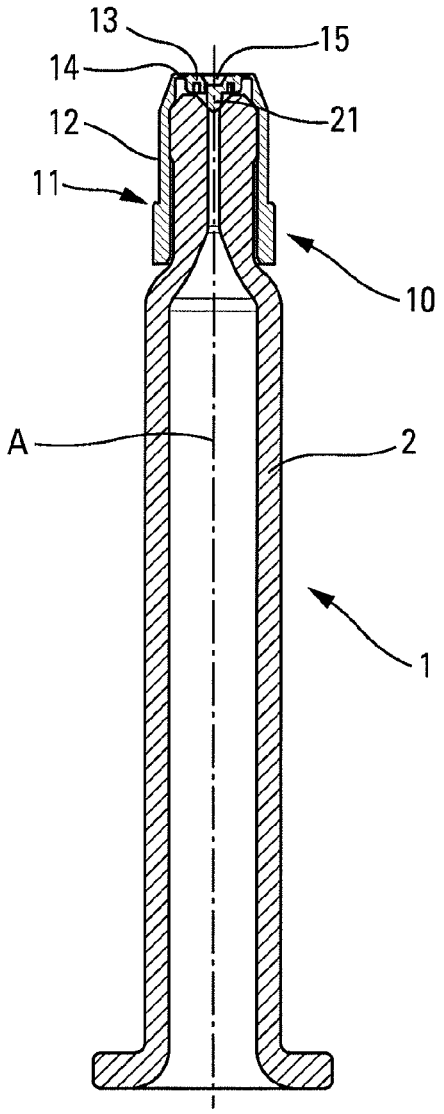
FIG. 7 is a view similar to the view in FIG. 1, showing another embodiment of the present invention.
Figure 8:
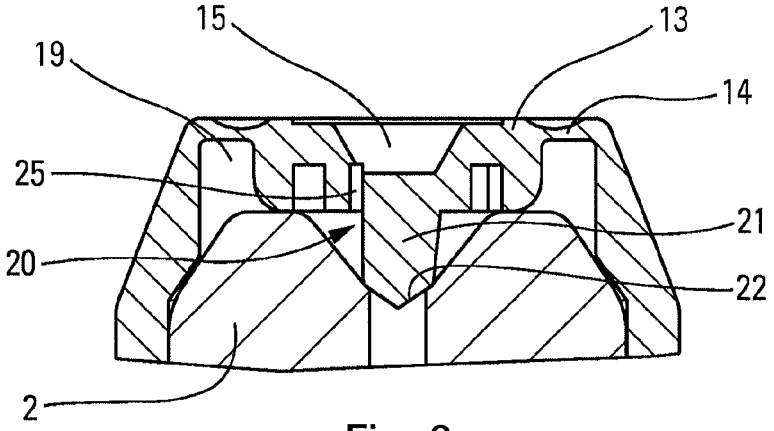
FIG. 8 is a larger-scale detail view of a portion of the FIG. 7 device.

FIGS. 7 and 8 show another embodiment of the present invention. In this embodiment, the bottom end 22 of the central pin 21 of the spray profile 20 forms an outlet valve. Thus, as can be seen in FIG. 8, the bottom end co-operates with the outlet orifice of the reservoir 2. Thus, in the rest position that is shown in FIG. 8, said central pin 21 closes the outlet of the reservoir 2. While the fluid is being expelled, said central pin 21 must thus be able to deform a little, preferably axially, so as to enable the fluid to be expelled. In the embodiment shown in FIGS. 7 and 8, said central pin 21, and more generally the end wall 13 of the hollow body 11, is connected to the sleeve 12 via a deformable diaphragm 14. Thus, while dispensing, it is the entire end wall 13 that deforms a little, thus causing the pin 21 to move axially, and the outlet valve 22 to open. In the embodiment in FIGS. 7 and 8, the spray channels 25 and the spray orifice 15 are made as in the embodiment in FIGS. 5 and 6, but naturally they could also be made like the first embodiment as described with reference to FIGS. 1 to 4, or even in some other way. As can be seen in particular in FIG. 8, the diaphragm 14 is made integrally with the hollow body 11 such that the spray head 10 is still made as a single piece. Advantageously, the diaphragm 14 is formed by narrowings in the walls created by recesses 19 formed in the end wall 13 of the hollow body 11. The embodiment in FIGS. 7 and 8 makes it possible not only to close the outlet of the syringe 2 at rest, but also makes it possible to create a pre-compression threshold. For the valve to open, it is necessary for there to be a predetermined pressure in the syringe. This avoids the risks of low-speed or low-pressure expulsion that may affect the quality of the spray. In order to ensure that the liquid swirls sufficiently to form a spray, it must be at a sufficient pressure when it passes into the spray profile, and the presence of the valve makes it possible to guarantee this minimum pressure.

The present invention provides a spray head that is made as a single piece, and that makes it possible to ensure that the fluid is sprayed properly on each actuation. In addition, the fact that the spray head is a single piece and that there is no assembly of one part in another, guarantees that all spray heads resulting from the same mold produce substantially the same performance, eliminating differences in performance that are associated with assembly, as generally occurs with spray heads comprising a plurality of parts. The single-piece structure of the head also makes it possible to use the syringe both in expulsion mode and in suction mode, in particular as a result of the absence of any movable parts or springs in the head.

Although the present invention is described above with reference to several embodiments thereof, naturally the invention is not limited to the embodiments described and shown in the drawings, but, on the contrary, any useful modification could be applied thereto by a person skilled in the art, without going beyond the ambit of the present invention, as defined by the accompanying claims. In particular, the various characteristics described with reference to the three embodiments could be combined together in any desirable manner.

The invention claimed is:

1. A fluid dispenser device, comprising:

a syringe having a longitudinal axis for containing a fluid and a piston that slides along the longitudinal axis within said syringe for dispensing the fluid; and a spray head assembled directly on said syringe, said spray head comprising: a hollow body comprising a sleeve that is substantially cylindrical and that extends along the longitudinal axis, and an end wall that is substantially radial and that is provided with a spray orifice; and a spray profile upstream from said spray orifice, said spray profile comprising at least one channel that is non-radial and/or non-axial relative to the longitudinal axis; wherein said head, said spray orifice, and said spray profile are made as a single piece, said spray profile including a central pin located on the end wall and inside of the hollow body, an internal end of said central pin, arranged inside said hollow body, having a conical or frustoconical shape, so as to guide the fluid towards said at least one non-radial and/or non-axial channel, said internal end forming an outlet valve.

2. The device according to claim 1, wherein said spray orifice is of annular shape around said longitudinal axis.

3. The device according to claim 1, wherein said spray orifice is in the shape of a bowl that is symmetrical about said longitudinal axis.

4. The device according to claim 1, wherein said at least one channel extends in sloping and peripheral manner relative to the longitudinal axis, connecting the inside of said hollow body to said spray orifice.

5. The device according to claim 1, wherein said at least one channel is helical and slopes in the radial and axial directions, connecting the inside of said hollow body to said spray orifice.

6. The device according to claim 1, wherein said central pin is connected to said sleeve via a deformable diaphragm made integrally therewith and enabling said central pin to move axially.

7. The device according to claim 1, wherein said outlet valve co-operates with said syringe.

8. A fluid dispenser device, comprising:

a syringe having a longitudinal axis for containing a fluid and a piston that slides along the longitudinal axis within the syringe for dispensing the fluid through an outlet orifice of the syringe; and a spray head assembled directly on the syringe, the spray head comprising a hollow body comprising a sleeve that is substantially cylindrical and that extends along the longitudinal axis, an end wall that is substantially radial and that is provided with a spray orifice; and a spray profile upstream from the spray orifice, the spray profile comprising a channel that is at least one of non-radial or non-axial relative to the longitudinal axis;

the spray profile comprises a central pin located on the end wall and inside of the hollow body, an internal end of the central pin is arranged inside said hollow body and has a conical or frustoconical shape so as to guide the fluid towards the channel, the internal end forming an outlet valve in cooperation with the outlet orifice of the syringe; and the spray head, including the spray orifice and the spray profile with the central pin are made as a one-piece integral construction.

9. The device according to claim 8, wherein the channel is non-radial relative to the longitudinal axis.

10. The device according to claim 8, wherein the channel is non-axial relative to the longitudinal axis.

11. The device according to claim 8, wherein the channel is non-radial and non-axial relative to the longitudinal axis.

12. The device according to claim 8, wherein the spray head, including the spray orifice and the spray profile with the central pin are molded as a one-piece integral construction.

13. The device according to claim 8, wherein the spray head, including the spray orifice and the spray profile with the central pin are molded as a one-piece integral construction from the same material.

14. The device according to claim 8, wherein the spray head is assembled directly on the syringe by inserting a portion of the syringe into the hollow body.

* * * * *